US006830410B2

(12) United States Patent
Davidson et al.

(10) Patent No.: US 6,830,410 B2
(45) Date of Patent: Dec. 14, 2004

(54) BUNK BEAM AND BUNK CUSHION APPARATUS FOR SUPPORTING A WATERCRAFT

(75) Inventors: Edward D. Davidson, Vashon, WA (US); Kenneth E. Hey, Seattle, WA (US)

(73) Assignee: Sunstream Corporation, Kent, WA (US)

( * ) Notice: Subject to any disclaimer, the term of this patent is extended or adjusted under 35 U.S.C. 154(b) by 89 days.

(21) Appl. No.: 10/335,973

(22) Filed: Dec. 31, 2002

(65) Prior Publication Data

US 2004/0126185 A1 Jul. 1, 2004

(51) Int. Cl.[7] ..... B63C 3/00

(52) U.S. Cl. ..... 405/3; 405/7; 280/414.1; 414/137.7; 414/139.4; 414/678

(58) Field of Search ..... 405/3–7; 280/414.1–414.3; 414/137.7, 139.4–139.8, 678; 114/44–48

(56) References Cited

U.S. PATENT DOCUMENTS

| | | | | | |
|---|---|---|---|---|---|
| 5,002,299 | A | | 3/1991 | Firehammer et al. | |
| 5,060,963 | A | | 10/1991 | Godbersen | |
| 5,076,603 | A | | 12/1991 | Godbersen | |
| 5,133,570 | A | | 7/1992 | Godbersen | |
| 5,158,315 | A | | 10/1992 | Godbersen | |
| 5,184,914 | A | * | 2/1993 | Basta | 405/3 |
| 5,275,505 | A | * | 1/1994 | Wilcox | 405/3 |
| 5,427,471 | A | * | 6/1995 | Godbersen | 405/3 |
| 5,839,851 | A | * | 11/1998 | Norfolk et al. | 405/3 |
| 5,908,264 | A | | 6/1999 | Hey | |
| 5,993,063 | A | | 11/1999 | Stewart | |
| 6,032,601 | A | | 3/2000 | Gates | |
| 6,253,699 | B1 | * | 7/2001 | Arbaugh et al. | 114/219 |
| 6,318,929 | B1 | | 11/2001 | Basta | |
| 6,453,837 | B1 | * | 9/2002 | Arbaugh et al. | 114/219 |
| 6,575,487 | B1 | * | 6/2003 | Krause | 280/414.1 |

* cited by examiner

*Primary Examiner*—Frederick L. Lagman
(74) *Attorney, Agent, or Firm*—George C. Rondeau, Jr.; Davis Wright Tremaine LLP

(57) ABSTRACT

The present invention is directed to an apparatus for supporting the hull of a watercraft using a flexible bunk beam and a convex cushion attached to the beam using locking elements. The beam has a longitudinal recess with a narrow upper neck portion and a larger lower anchor portion, and the cushion has an elongated cushion locking member lockably insertable into the recess. The cushion locking member has a narrow upper neck portion and a larger lower portion sized to snuggly fit within the recess. The cushion includes internal voids and walls. The beam includes sidewalls with bores forming bearing surfaces.

54 Claims, 7 Drawing Sheets

BUNK BEAM AND BUNK CUSHION APPARATUS FOR SUPPORTING A WATERCRAFT

BACKGROUND OF THE INVENTION

A hull of a watercraft may encounter a variety of problems when it remains submerged in a lake, bay or other body of water for a protracted period of time. For example, exterior surfaces of the hull that are submerged in the water may acquire a significant amount of marine growth that may impair the performance of the watercraft and superficially damage the hull if not frequently removed. Further, the hull may be subjected to significant physical damage in cases where the hull is exposed to strong wave activity resulting from weather conditions or the wakes of passing watercraft. This damage generally occurs where the hull of the watercraft repeatedly contacts a stationary object such as a portion of a dock or buoy, or even another watercraft that is docked or moored nearby.

Although the foregoing difficulties may largely be avoided by removing the watercraft from the water and transporting the watercraft to a storage location when the watercraft is not in use, this approach is seldom employed, since a significant effort is generally required to remove and transport the watercraft, and is particularly inconvenient in situations where the watercraft is subject to frequent use.

One approach that addresses the foregoing difficulties is a watercraft lift. An example of one type watercraft lift is described in U.S. Pat. No. 5,908,264 to Hey, which is incorporated by reference herein. The watercraft lift generally includes a user-actuated mechanical lifting mechanism that is positioned below the watercraft and moved upward to engage the hull of the watercraft and lift the watercraft from the water and to support watercraft above the surface of the water when not in use. When it is desired to refloat the watercraft, the user is able to lower the lifting mechanism to lower the watercraft into the water. The watercraft lift is therefore a particularly convenient solution to the foregoing difficulties, since the watercraft may be quickly removed from the water during periods of non-use, and refloated when desired, with minimal human effort.

FIELD OF THE INVENTION

This invention generally relates to an apparatus for supporting a hull of a watercraft, and more particularly, to a hull support apparatus that may be used with a watercraft lift.

BRIEF SUMMARY OF THE INVENTION

The present invention is directed to an apparatus for supporting the hull of a watercraft. In one aspect of he invention, a bunk beam and bunk cushion assembly is provided, which includes an elongated bunk beam having an elongated cushion support surface portion oriented at a predetermined fixed angle to the horizon so as to be facing toward the hull of the watercraft when in use to support the watercraft, and an elongated bunk cushion having a lower surface portion in supporting engagement with the cushion support surface portion of the bunk beam and an upper watercraft support surface portion engageable with the watercraft hull. The cushion upper surface portion is convex in shape and projects away from the cushion lower surface portion. The cushion support surface portion of the bunk beam holds the cushion upper surface portion facing toward the hull of the watercraft for engagement therewith when in use to support the watercraft. The bunk cushion and the bunk beam being attached together in stationary relation for movement as a unit.

In another aspect of the invention, the assembly includes an elongated bunk beam having an elongated cushion support surface portion and a longitudinally extending slot, and an elongated bunk cushion having a lower surface in supporting engagement with the cushion support surface portion of the bunk beam and an upper watercraft support surface engageable with the watercraft hull. The bunk cushion has a longitudinally extending locking rib projecting away from the cushion lower surface and into the slot. The cushion locking rib has a thickness sufficient to provide shear strength to maintain the bunk cushion in position on the cushion support surface portion of the bunk beam against side loading forces exerted by the watercraft during use.

The bunk beam has sufficient stiffness to support a portion of the weight of the watercraft transmitted through the bunk beam without permanent deformation but is yieldable to at least partially conform to the shape of the watercraft hull under the portion of the weight of the watercraft supported thereby.

The assembly may be used for attachment to first and second booms rotatable in a substantially vertical plane. The bunk beam includes at least one attachment member configured to be pivotally attached to the first and second booms to move the bunk beam and bunk cushion as a unit in the substantially vertical plane with the first and second booms, with the bunk beam and bunk cushion comprising a non-movable assembly when in an elevated position supporting the hull of the watercraft.

The slot in the bunk beam may be a portion of a longitudinally extending recess therein having a neck portion toward the cushion support surface and an anchor portion positioned away from the cushion support surface. The recess anchor portion has a width greater than the recess neck portion. The locking rib may have a neck portion toward the cushion lower surface and a lock portion positioned away from the cushion lower surface, with the cushion neck portion having a width sized to fit within the recess neck portion and the cushion lock portion having a width sized to lockably fit within the recess anchor portion. The cushion lock portion width is greater than the recess neck portion and has a thickness sufficient to not pull through the recess neck portion to maintain the bunk cushion in position on the cushion support surface portion of the bunk beam against lifting forces exerted by the watercraft during use.

In the disclosed embodiment, the bunk beam has a set of first locking elements and the bunk cushion has a set of second locking elements coupled together to form a bunk beam and bunk cushion assembly. The bunk beam has a cushion support surface portion configured to support a cushion lower surface and the plurality of first locking elements include a longitudinally extending central recess in the bunk beam projecting away from the cushion support surface.

In the disclosed embodiment, the plurality of first locking elements further include a pair of oppositely projecting flange portions, and the plurality of second locking elements further include a pair of oppositely projecting side extensions. Each of the side extensions extend around and grasp a correspondingly positioned one of the pair of flange portions.

The assembly is usable for attachment to a pair of support booms. The bunk beam can include first and second support webs or sidewalls rigidly attached to an attachment surface having the cushion support surface to which the bunk cushion is attached. The first and second support webs project away from the attachment surface on a side thereof away from the cushion support surface and are configure to attach to the support booms. The first and second webs have toward each end portion of the bunk beam a transverse bore sized to receive a pin for pivotal connection of the bunk beam to a correspondingly positioned one of the pair of support booms. The first and second webs having a lower wall portion and an upper wall portion positioned between the lower wall portion and the cushion support surface portion. The lower wall portion has a wall thickness greater than the wall thickness of the upper wall portion in at least the area around the transverse bores to provide within the transverse bores a bearing surface for engagement with the pin when extending therethrough.

DETAILED DESCRIPTION OF THE INVENTION

The present invention is generally directed to an apparatus and method for supporting a hull of a watercraft, and more particularly, to a hull support apparatus and method that may be used with a watercraft lift.

Figure 1:
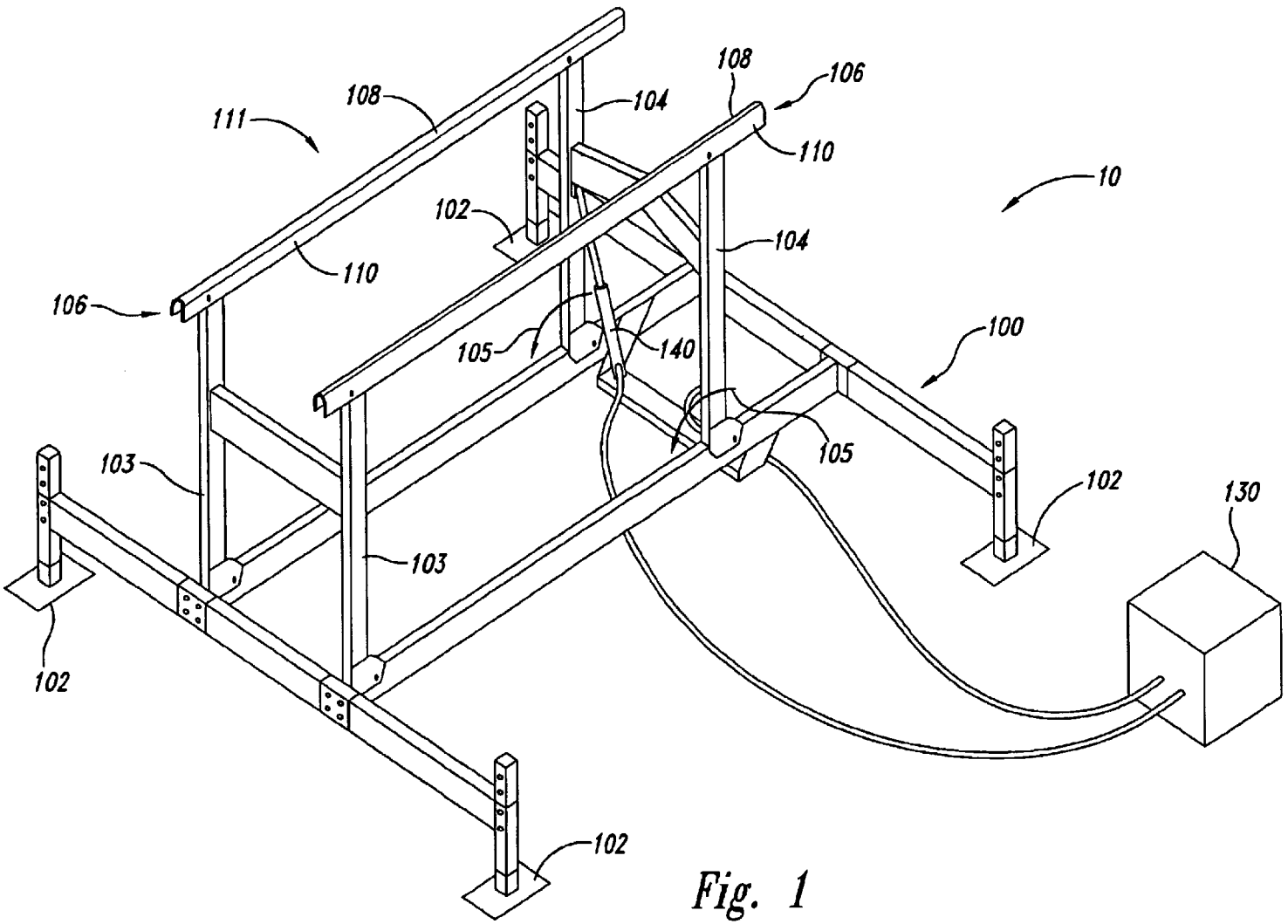
FIG. 1 is an isometric view of a watercraft lift utilizing a bunk beam and bunk cushion assembly according to the present invention.

An isometric view of a watercraft lift 10 utilizing the present invention is shown in FIG. 1. The lift 10 is depicted in a fully extended position but may be moved between the raised position shown and a lowered position. The lift 10 includes a base frame 100 that is supported by lower end shoes 102 that rest on the bottom of a body of water. Left and right side forward booms 103 are hingeably connected at a lower end to the base frame 100 at one end thereof, and left and right side rearward booms 104 are hingeably connected at a lower end to the base frame at an opposing end thereof. A bunk beam and bunk cushion assembly 106 extends between and is hingeably connected to the upper ends of the left side forward and rearward booms 103 and 104, and another bunk beam and bunk cushion assembly extends between and is hingeably connected to the upper ends of the right side forward and the rearward booms to form a pair of spaced apart and approximately parallel hull supports.

The bunk beam and bunk cushion assembly 106 includes a bunk cushion 108 that is positioned on an elongated bunk beam 110. The bunk cushion 108 is generally comprised of a soft, compliant material to properly support the hull and to avoid marring the hull surface. The bunk beam and bunk cushion assemblies 106 thus form a support platform 111 that supports the watercraft while it is positioned on the watercraft lift 10.

Still referring to FIG. 1, the operation of the watercraft lift 10 will now be briefly described. A watercraft (not shown) is positioned over the support platform 111 and generally between the parallel, spaced apart bunk beam and bunk cushion assemblies 106 with the support platform 111 in a lowered position (not shown) below the surface of the water. A fluid power source 130 may then be actuated by a user to provide pressurized fluid to left and right side actuators 140 (only one being visible in FIG. 1). The left and right side actuators 140 extend between the base frame 100 and a corresponding one of the left and right side rearward booms 104 to rotate the forward and rearward booms 103 and 104 in a direction 105 about their hinge connection to the base frame to move the bunk beam and bunk cushion assemblies 106 upwardly toward the elevated position shown in FIG. 1.

As the bunk beam and bunk cushion assemblies 106 move upwardly they contact the hull of the watercraft and lift the hull of the watercraft substantially out of the water. When it is desired to refloat the watercraft, the user may actuate the fluid power source 130 to release the internal pressure from each of the actuators 140, thus allowing the forward and rearward booms 103 and 104 to rotate in the direction opposite direction 105 and return to their lowered position. The watercraft may then be moved away from the watercraft lift 10.

Since the bunk beam and bunk cushion assemblies 106 support the watercraft hull, they are generally configured to adapt to the size and shape of the watercraft hull in order to prevent superficial and/or structural damage to the hull. For example, as shown in FIG. 1, the assemblies 106 may be angled inwardly to maintain a fixed angle with respect to a watercraft hull to support the hull while the watercraft is in an elevated position on the lift 10.

A conventional bunk beam and bunk cushion assembly used with many watercraft lifts comprise a wood board covered by a durable fabric, such as carpet, with the board attached to its support structure. Such a board configuration may not, however, properly support a variety of different hull shapes and sizes. Further, the wood board is susceptible to rot after prolonged exposure to the weather and water, and the bolts holding the board in place can work loose and allow the bolt heads to scratch the hull of the watercraft. While treated wood boards solve some of these problems, treated wood in not allowed in many marine environments due to environmental protection laws. Aluminum extrusions have been used for bunk beams, covered by a thin, flat bunk cushion made of a soft material, but keeping the bunk cushion in position on the bunk beam has been a problem when the hull of a watercraft is engaged by the assembly. Further, the aluminum extrusions did not tend to conform significantly to the shape of the hull being supported.

Figure 2:
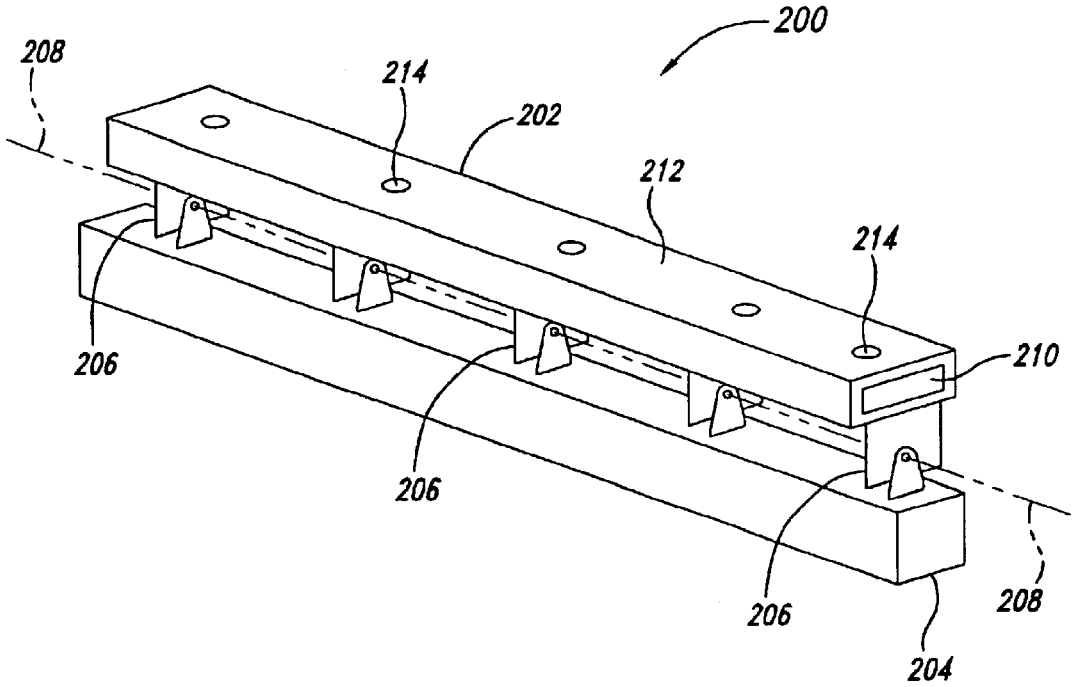
Fig. 2 (Prior Art)
FIG. 2 is an isometric view of a bunk beam and bunk cushion assembly according to the prior art.

FIG. 2 is an isometric view of a prior art bunk beam and bunk cushion assembly 200 commonly used in an attempt to overcome the problems associated with a fixed angle bunk beam. The assembly 200 includes a bunk cushion 202 rotatably supported by a bunk beam 204 using a plurality of hinges 206 that extend between the bunk cushion and the bunk beam and permit the bunk cushion to rotate about a longitudinal axis 208. The bunk cushion 202 may comprise a central support member 210, such as a wood board, that is covered by a cushioning layer 212, such as a durable fabric or an elastomeric material. The bunk cushion 202 is typically attached to the hinges 206 by a plurality of bolts 214 or other fasteners having heads exposed at the surface of cushioning layer 212.

Although the assembly 200 permits the bunk cushion 202 to rotatably adapt to various watercraft hull shapes, the assembly exhibits other significant disadvantages. For example, wood is frequently used to form the central support member 210, which is susceptible to rot. The material comprising the cushioning layer 212 may similarly be subject to decay. Still further, the hinges 206 may be subject to corrosion, or other mechanical malfunctions and thus may require periodic maintenance.

Accordingly, there is a need in the art for a bunk cushion and bunk beam assembly that conforms to a variety of hull sizes and shapes. Moreover, there is a need for a bunk cushion and bunk beam assembly that is resistant to deterioration and/or corrosion when exposed to water, and has other advantages.

Figure 3:
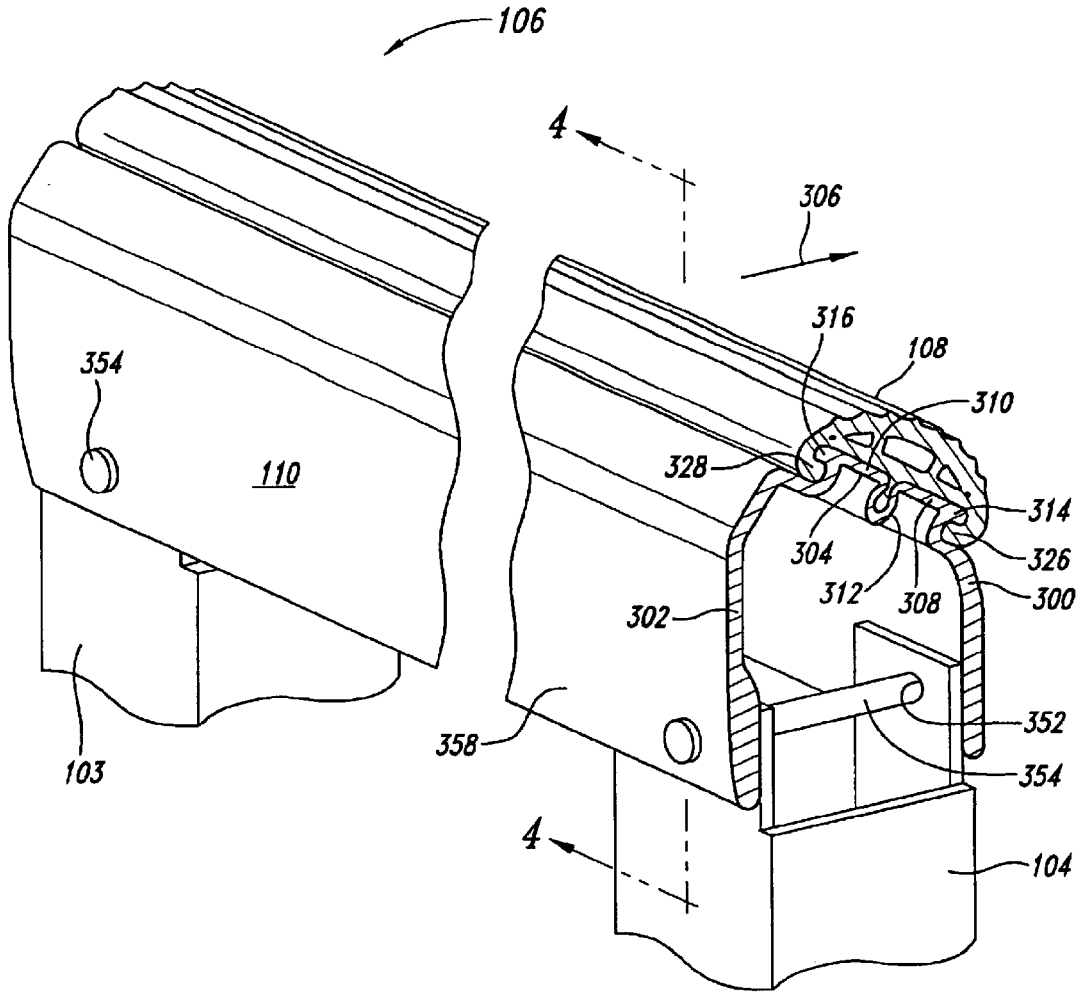
FIG. 3 is an enlarged, isometric fragmentary view of a bunk beam and bunk cushion assembly of FIG. 1.

An enlarged isometric view of one bunk beam and bunk cushion assembly 106, which includes the bunk cushion 108 positioned on the bunk beam 110, according to one embodiment of the invention, is provided in FIG. 3. As described above, two such bunk beam and bunk cushion assemblies 106 form the support platform 111 that supports a watercraft. The bunk beam 110 includes an elongated inward sidewall or web 300, an opposing, elongated outward sidewall or web 302, and an elongated attachment portion 304 that extends laterally between the upper ends of the inward and outward webs 300 and 302 and is rigidly attached to both. The bunk beam 110 has an open lower side and has an unobstructed elongated central channel to provide a spring channel beam that can flex and conform somewhat to the shape of the hull of a watercraft being supported by the bunk beam and bunk cushion assemblies 106 of which the bunk beam is a part. This provides sufficient compression strength and stiffness to support the load of a watercraft, but yet provide flexibility to improve distribution of the watercraft weight along the beam with the amount of flexure dependent on the weight of the watercraft being supported.

The bunk beam 110 may be comprised of any material that affords sufficient structural rigidity and durability, and the desired flexibility, and may be fabricated by various processes. One embodiment of the bunk beam 110 is comprised of aluminum formed by an extrusion process. The inward web 300 is shorter in height than the outward web 302 so that the attachment portion 304 is tilted at an angle so as to face in the inward direction toward the hull of the watercraft being supported during use, indicated by arrow 306, to allow the bunk beam and bunk cushion assembly 106 to better accommodate the sloping hull of a watercraft (see FIG. 6). Alternatively, a "C" channel beam may be used.

The attachment portion 304 has substantially flat, inward and outward elongated support surface portions 308 and 310, respectively, with an elongated grooved portion 312 positioned therebetween. The support surface portions 308 and 310 are in general coplanar arrangement and oriented at a predetermined fixed angle to the horizon so as to be facing toward the hull of the watercraft when in use to support the watercraft. The attachment portion 304 provides a stationary, fixed angle support for the bunk cushion 108 when in use supporting the watercraft, with no moving parts. The bunk beam 110 so constructed can be attached to the forward and rearward booms 103 and 104 for rotation thereof in a generally vertical plane about their hinge connection to the base frame 100 to move the bunk beam and bunk cushion assembly 106 substantially vertically upwardly and downward into and out of engagement with the watercraft hull with the bunk cushion 108 at an angle facing toward the hull. As will be described below, using the radius shaped bunk cushion 108, the bunk beam and bunk cushion assembly 106 can support a wide variety of hull shapes and dead rises. As used herein, references to the bunk beam and bunk cushion assembly 106, and more particularly the bunk cushion 108, engaging the watercraft hull means a supporting contact engagement without requiring any interlocking connection with the hull.

Projecting inwardly from the inward side of the inward support surface portion 308 is an elongated inward locking flange 314, and projecting outwardly from the outward side of the outward support surface portion 310 is an elongated outward locking flange 316. An inward side recess portion 318 is provided below the inward locking flange 314 at the juncture of the attachment portion 304 and the inward web 300, and an outward side recess portion 320 is provided below the outward locking flange 316 at the juncture of the attachment portion and the outward web 302. The attachment-portion 304 supports and has attached thereto the elongated bunk cushion 108.

Figure 4:
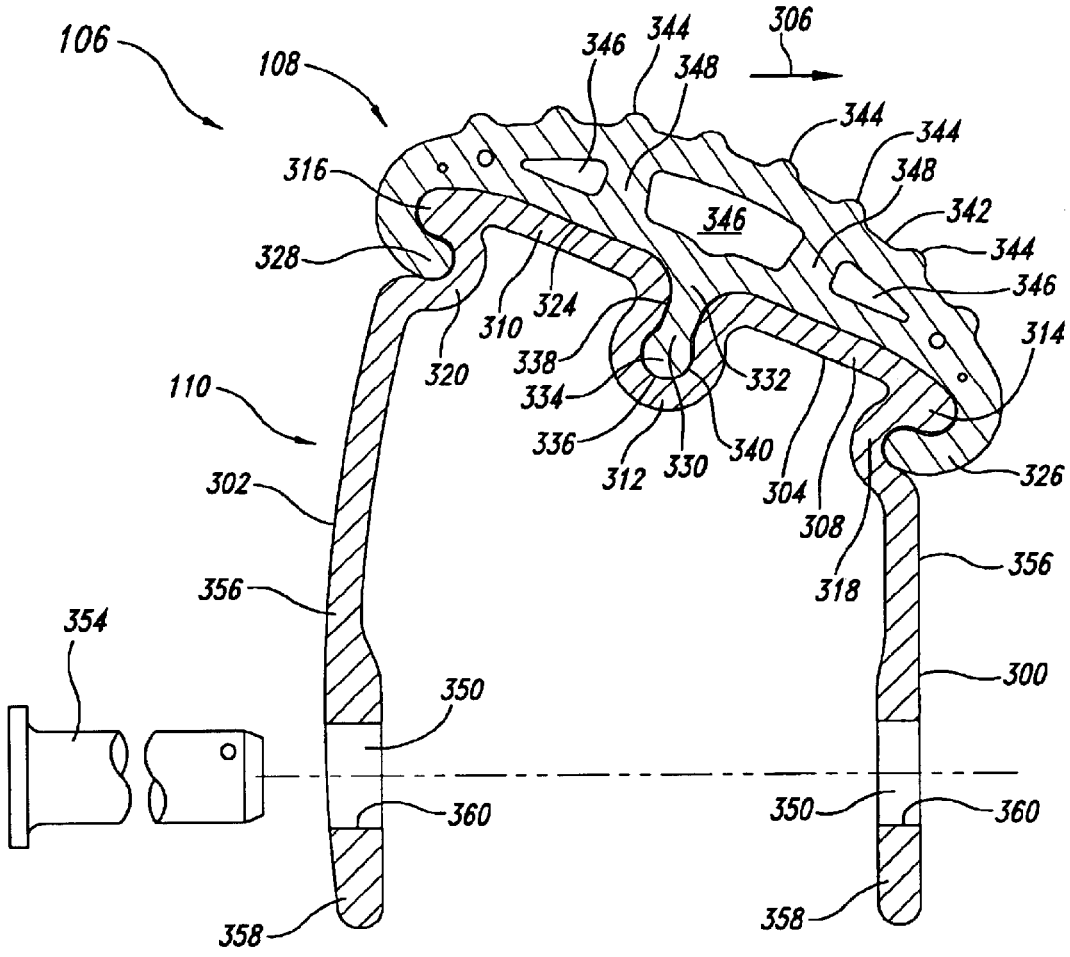
FIG. 4 is a sectional view taken substantially along line 4—4 of FIG. 3.

The cushion 108 may be comprised of any suitably flexible and resilient material, such as various synthetic rubbers or elastic polymeric materials. For example, silicone rubber, or a soft polyurethane may be used to form the cushion 108, although other materials may also be used. As best shown in FIG. 4, the cushion 108 has an elongated lower surface portion 324 that abuts and rest upon the upward surfaces of the inward and outward support surface portions 308 and 310 and the inward and outward locking flanges 214 and 316 of the attachment portion 304 of the bunk beam 110. The cushion 108 further includes an elongated inward side locking element 326 that wraps around the inward side locking flange 314 of the beam attachment portion 304 and projects into an elongated, inwardly facing recess defined by the inward side recess portion 318, and an elongated outward side locking element 328 that wraps around the outward side locking flange 316 of the beam attachment portion and projects into an elongated, outwardly facing recess defined by the outward side recess portion 320, to help lock the cushion 318 in place atop the beam attachment portion. The use of such inward and outward side locking elements by themselves, however, does not provide sufficient attachment of the cushion 108 to the attachment portion 304 of the bunk beam 110 to hold it in place during usage when engaging a watercraft which due to its weight can apply significant side loading forces (generally inward and outward) to the cushion which tend to peel or pull it from the bunk beam.

To better hold the cushion 108 in place, the cushion includes an elongated central locking rib or tab member 330 that extends downwardly from the lower surface portion 324 of the cushion and projects into the grooved portion 312 of the attachment portion 304 of the bunk beam 110. The central locking member 330 has a tonsil shaped cross-section with a narrow upper neck portion 332 and an enlarged lower portion 334. The grooved portion 312 of the attachment portion 304 of the bunk beam 110 extends downward from the inward and outward support surface portions 308 and 310, and has a similar tonsil shaped cross-section, defining a centrally disposed, upwardly acing recess 336. The recess 336 has an upper neck portion 338 located toward the inward and outward support surface portions 308 and 310 forming an longitudinally extending slot in the attachment portion 304 of the bunk beam 110 located between the support surface portions 308 and 310, and a lower bulbous anchor portion 340 positioned below the upper neck portion 338. The lower anchor portion 340 has a width greater than the width of the upper neck portion 338. The upper neck portion 338 and the lower anchor portion 340 of the recess 336 are sized to snuggly receive and retain therein the upper neck portion 332 and the lower portion 334 of the central locking member 330, with the central locking member substantially filling the recess and contacting the interior wall surfaces of the recess.

The lower portion 334 of the central locking member 330 is sufficiently resilient and of a cross-sectional size relative to the width of the upper neck portion 338 of the recess 336 that when the central locking member 330 is pressed into the recess, the lower portion 334 compresses as it passes through the recess upper neck portion 338 and then expands when within the recess lower anchor portion 340, to produce a snap fit and securely retain the central locking member in the recess and thereby securely attach the cushion 108 to the bunk beam 110 against peeling or pulling from bunk beam 110 without the use of bolts to connect the cushion to the bunk beam as often done in the past. The central locking member 330 is illustrated as a continuous rib or tab member, but may be formed by an elongated series of discontinuous tabs projecting downwardly from the lower surface portion 324 of the cushion and into the grooved portion 312 of the attachment portion 304 of the bunk beam 110. It is noted that with the cushion 108 and attachment portion 304 design of the present invention, the cushion is fixedly attached to the bunk beam 110 without moving parts and does not utilize the hinges 206 of the prior art bunk beam and bunk cushion assembly 200 shown in FIG. 2, but yet, as will be described below, overcomes the problems associated with prior art bunk beam.

The upper neck portion 338 of the recess 336 is formed by opposing rounded wall portions and the lower portion 334 of the central locking member 330 has a round shape to facilitate its insertion into the upper neck portion of the recess. The upper neck portion 332 of the central locking member 330 has a cross-sectional thickness of a size sufficient to provide adequate shear strength to withstand the side loading force exerted by a watercraft to the cushion 108 which tend to peel or pull it from the bunk beam 110.

The cushion 108 has an elongated, convex upper surface 342 that extends between the inward side locking element 326 and the outward side locking element 328. A plurality of elongated ribs 344 project upwardly for the upper surface 342 of the cushion 108. The cushion 108 has three elongated, central internal pockets or voids 346 that permit the cushion to deform in the area of contact with a hull surface of a watercraft being supported by the bunk beam and bunk cushion assembly 106 of which the cushion is a part, and also easily deform around any the contours of the watercraft encountered by the cushion, such as a strake. The three central voids 346 are separated by two elongated internal walls 348 of sufficient cross-sectional wall thickness to provide the strength and resiliency desired for the cushion 108 when under the load of a watercraft.

Figure 5:
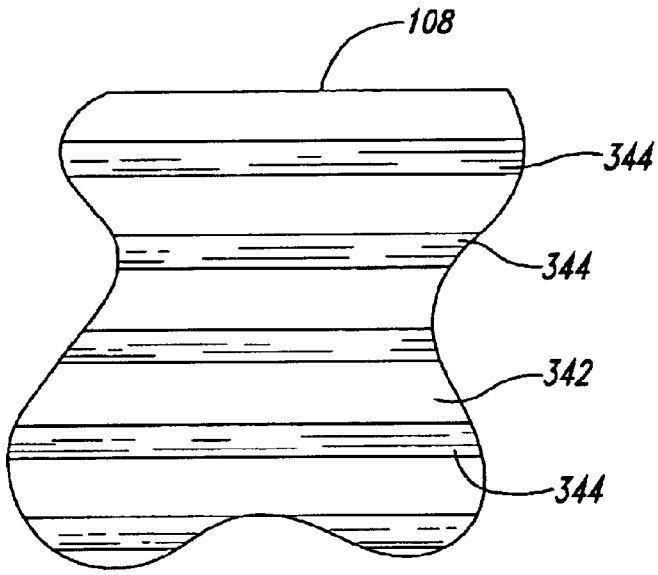
FIG. 5 is a fragmentary, enlarged top plan view of a surface portion of the bunk cushion assembly shown in FIG. 3.

FIG. 5 is a fragmentary, enlarged top plan view of a surface portion of the upper surface 342 of the cushion 108 showing the upwardly projecting ribs 344 disposed on the upper surface 342 of the cushion and extend along substantially the full length of the surface. The ribs 344 have an arcuate cross-sectional shape and a height such that the ribs are shallow enough that in combination with the convex curvature of the upper surface 342 of the cushion 108, they do not collect sand and grime that might scratch the hull surface of the watercraft being supported by the bunk beam and bunk cushion assembly 106. This open faced surface essentially provides a self-cleaning feature and is unlike carpet and other materials which tend to trap sand and grime which can damage the watercraft being supported. The upper surface 342 of the cushion 108 is selected to be impermeable to water.

While not illustrated, a bolt may be used toward each end of the bunk beam 110 to secure the cushion 318 against longitudinal movement along the bunk beam. Alternatively, longitudinal movement may be eliminated by gluing he cushion to the bunk beam, by crimping the cushion to the bunk beam, by use of end caps blocking longitudinal movement, or other suitable means.

Each of the two bunk beam 110 of the two bunk beam and bunk cushion assemblies 106 comprising the support platform 111 is attached to each of the forward and rearward booms 103 and 104 of the watercraft lift 10 using a single point pivotally attachment to provide two point support for each bunk beam. At each of the longitudinal end portions of the bunk beam 110 the inward and outward webs 300 and 302 thereof each have a bore 350 that projects therethrough. The correspondingly located bores 350 of the inward and outward webs 300 and 302 are in a collinear arrangement. The corresponding web bores 350 at one end portion of the left side bunk beam 110 align with a pair of bores 352 in the upward end portions of the left side forward boom 103, and the corresponding web bores at other end portion of the left side bunk beam align with a pair of bores in the upward end portions of the left side rearward boom 104 (see FIG. 3). In the illustrated embodiment, a pin 354 projects through each set of the aligned web bores and boom bores. The right side bunk beam is similarly attached using a pair of pins 354 to the right side forward and rearward booms 103 and 104.

Since the load of a watercraft supported by the two bunk beam and bunk cushion assemblies 106 comprising the support platform 111 is transmitted to the forward and rearward booms 103 and 104 of the watercraft lift 10 through only four pins 354, the bearing weight on each pin, and hence the inward and outward web 300 and 302 of the bunk beam 110 can be relatively large. As such, each of the inward and outward webs 300 and 302 has an elongated upward wall portion 356 and an elongated lower wall portion 358. The lower wall portion 358 has an enlarged cross-sectional thickness such that the bore 350 therethrough produces a suitably large sidewall bearing surface 360 which engages the pin 352 extending through the bore to minimize drag and wear as the bunk beams 110 are raised and lowered, especially when the support platform 111 supports a watercraft, and as the wave action causes movement of the watercraft lift 10 that in the past has tended to cause enlarging wear of bunk beam pivot holes. While the sidewall of the lower wall portion 358 of the inward and outward webs 300 and 302 need only have an enlarged sidewall in the area of the bores 350 to provide the bearing surfaces 360 for the pins 352, in the illustrated embodiment the entire length of the lower wall portion has the enlarged sidewall thickness to add the desired amount of stiffness to the beam 110 along its length.

The load of a watercraft supported by the two bunk beam and bunk cushion assemblies 106 comprising the support platform 111 is typically not uniformly distributed between the inward web 300 and the outward web 304, and the inward web positioned toward the hull of the watercraft tends to support more of the load than the outward web. To provide appropriately sized bearing surfaces 360 for the load encountered by each web, the lower wall portion 358 of the inward web 300 is fabricated with a larger sidewall thickness than the lower wall portion of the outward web 302, as clearly illustrated in FIG. 4.

Figure 6:
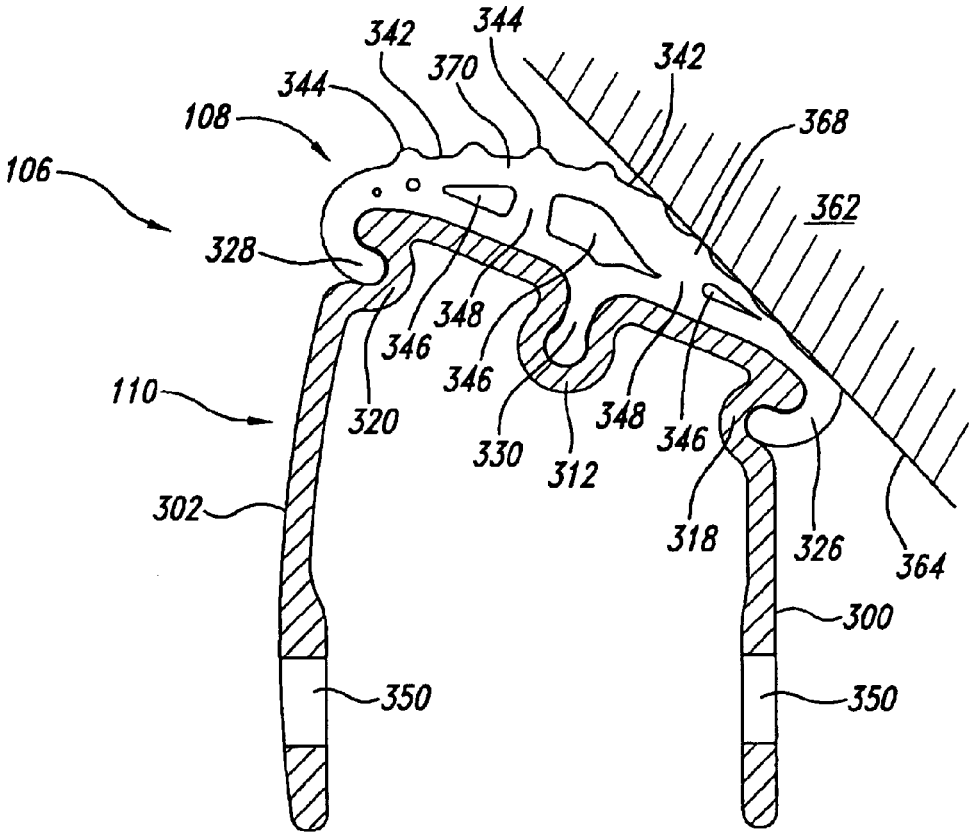
FIG. 6 is the sectional view of the bunk beam and bunk cushion assembly of FIG. 4 shown supporting a hull of a watercraft.
Figure 7:
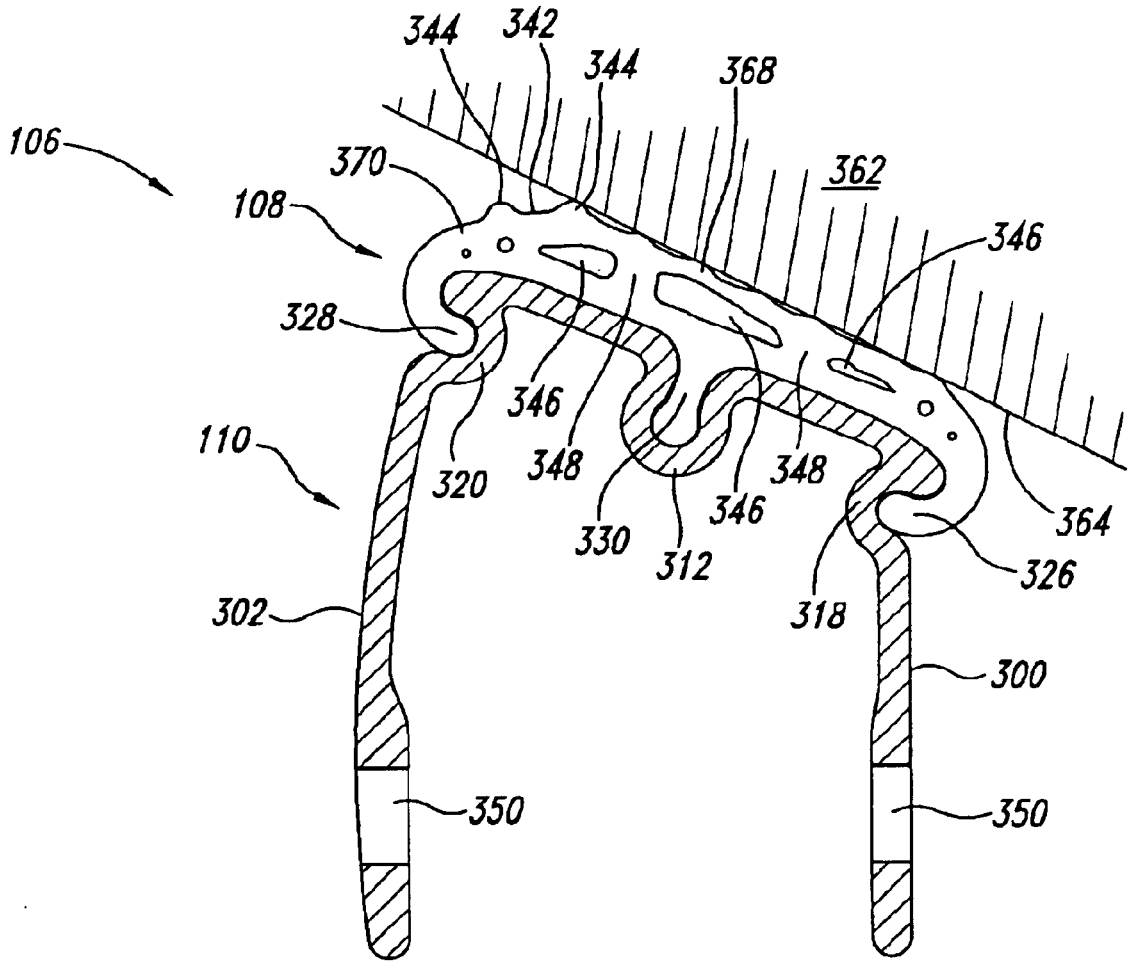
FIG. 7 is the sectional view of the bunk beam and bunk cushion assembly of FIG. 4 shown supporting a hull of another watercraft with a different dead rise.

The cushion 108 has a cross-sectional height, radius and stiffness selected such that under a normal watercraft load thereon, the cushion will yield or compress to conform to the hull shape of the watercraft being supported to distribute the load of the watercraft and is able to support watercraft hulls with a wide variety of hull shapes and dead rise (upward slant of the hull). The compliant characteristics of the cushion 108 is illustrated in FIG. 6, which shows the cushion engaging and supporting a boat 362 with a hull surface 364 having a particular dead rise in a hull surface portion engaged by the cushion. The cushion 108 is capable of being highly compressed in a bunk region 368 adjacent to the hull surface portion engaging the cushion due to the presence of the internal voids 346, while remaining in a relatively non-compressed condition in adjacent bunk regions such as bunk region 370 shown in FIG. 6. The size and height of the cushion 108 is large enough to allow the cushion to support hulls of different dead rise and hull shapes without adjusting the positioning of the cushion, rather a different bunk region or area of compression will be experienced by the cushion, such as shown in FIG. 7. Essentially, the cushion 108 is self-adjusting to the different hull dead rises and shapes without the need to adjust the angle of the cushion or the bunk beam supporting it, as was necessary with the prior art. While the cushion 108 is compressible and yielding, the two internal walls 348 adjacent to the internal voids 346 and the stiffness of the material selected for the cushion provide the strength and resiliency desired for the cushioning the hull surface portion of the watercraft over the bunk region 368 rather than just a point loading. As will be understood, if the boat 362 had a different dead rise or the cushion 108 engaged a differently sloping portion of the hull surface of the boat, the cushion would still provide conforming support for the hull.

As described above, further conforming support is provided for the hull of the boat 362 by the construction of the bunk beam 110 supporting the cushion 108. The bunk beam 110 has a section modulus and construction that provides the needed strength and stiffness, but yet sufficient flexibility and yielding that it can conform somewhat to the shape of the boat hull. The desired flexibility is in-part achieved by using a two position support arrangement for the bunk beam 110, with the forward and rearward booms 103 and 104 being attached to the bunk beam only toward its forward and rearward end portions with a long, unsupported length of the bunk beam extending therebetween. Of course, the cushion 108 attached to the bunk beam 110 is sufficiently flexible to bend with and assume the contour of the bunk beam, to thereby even better conform to the hull shape beyond the conformance achieved by the construction of the cushion described above.

The ribs 344 further assists the cushion 108 to support the hull of the watercraft by providing some additional compliance. The ribs 344 additionally permit surface friction between a hull surface 364 and the cushion 108 to be minimized, since contact between the cushion and the hull surface occurs principally at the ribs.

The illustrated embodiment of the invention provides a number of benefits, many of which have been previously mentioned. For one, the cushion 108 is directly attached to the bunk beam 110 to form a durable, unitary assembly that is substantially resistant to corrosion and decay. Additionally, since the inward and outward webs 300 and 302 are of different heights and configurations, the attachment portion 304 of the bunk beam 110 and hence the cushion 108 supported thereby can be angled towards the hull of the watercraft to better accommodate the generally sloping shape of the hull. This feature advantageously augments the convex upper surface 342 of the cushion and its substantial height above the bunk beam 110 to permit the assembly to adapt to a wide variety of watercraft hull configurations, without employing moving parts, such as hinges, or other like components. As noted, the flexibility of the bunk beam 110 further aids this end. The internal construction of the cushion 108 using internal voids 346 and internal walls 348 that may be varied in size and position also helps achieve a more compliant bunk cushion.

Figure 8:
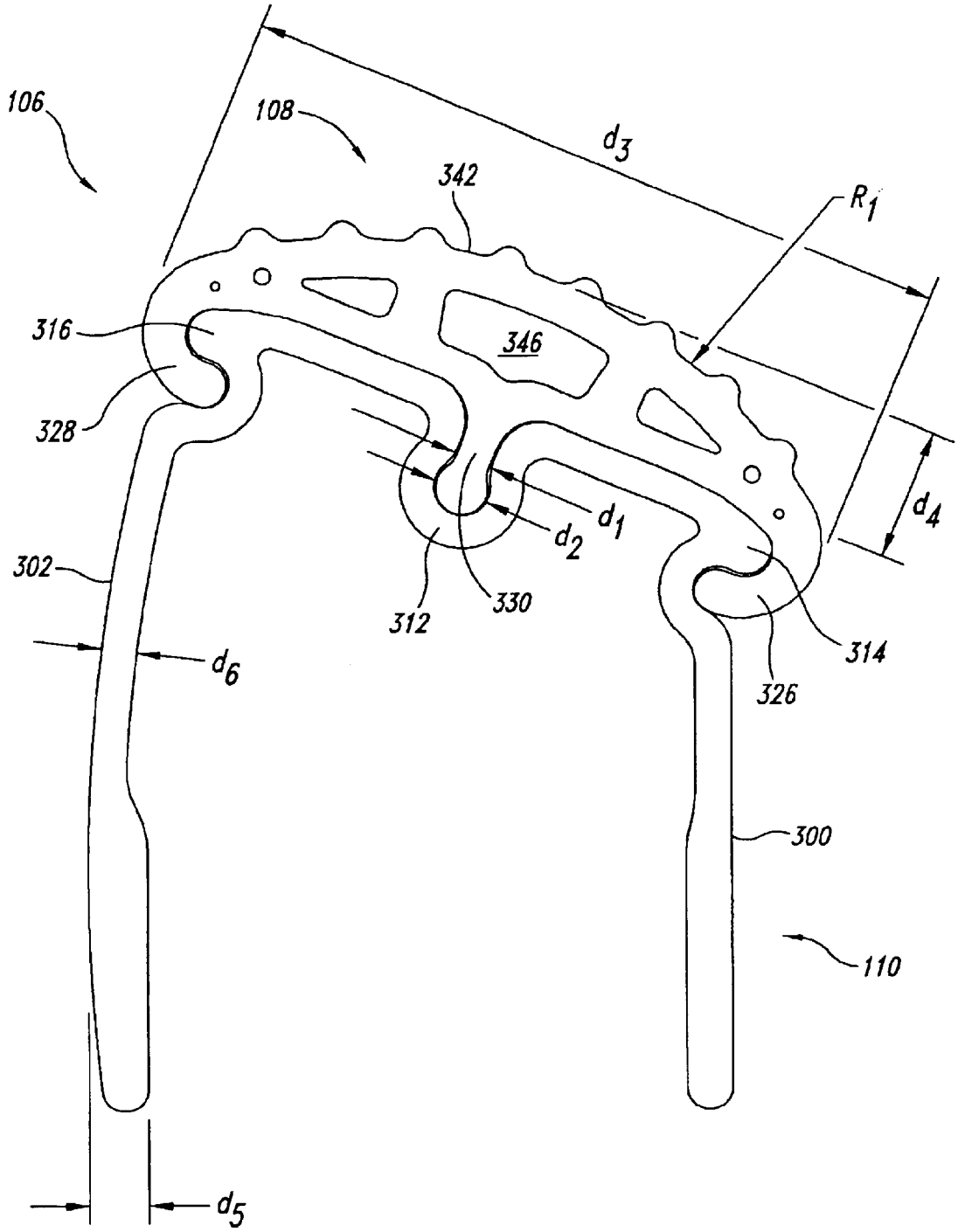
FIG. 8 is the sectional view of the bunk beam and bunk cushion assembly of FIG. 4 showing relational dimensions.

The cushion 108 and the bunk beam 110 are sized to provide improved performance. As shown in FIG. 8, the cross-sectional width d1 of the upper neck portion 332 of the central locking member 330 is 0.7 times the cross-sectional width d2 of the lower portion 334 of the central locking member (i.e., d1=0.7*d2). The cushion 32 has a cross-sectional height d4 that is 0.1875 times the overall cross-sectional width d3 of the cushion 108 (i.e., d4=0.1875*d3). The cushion 108 has a stiffness selected such that under a normal watercraft load thereon, the cross-sectional height d4 will compress up to a maximum of 50% of its unloaded cross-sectional height (i.e., compress no greater than a loaded cross-sectional height of 0.5*d4). The cross-sectional top surface curvature R1 of the cushion 108 is 0.75 times the overall cross-sectional width d3 of the cushion (i.e., R1=0.75*d3). To provide the strength needed for the attachment of the bunk beam 110 to the forward and rearward booms 103 and 104 using the attachment pins 354, the bunk beam lower wall portion 358 of the outward web 302 has a cross-sectional sidewall thickness d5 which is 1.8 times the cross-sectional sidewall thickness d6 of the bunk beam upward wall portion 356 (i.e., d5=1.8*d6). Further, the outward web 302 has a beam stiffness to provide a 1.0 inch defection at 60% of the normal watercraft load thereon using a 110 inch spacing between the attachment pins 354 for the bunk beam 110.

It will be appreciated that, although specific embodiments of the invention have been described herein for purposes of illustration, various modifications may be made without departing from the spirit or scope of the invention. Although disclosed embodiments of the bunk beam and cushion assembly have been discussed in connection with a watercraft lift, it should be understood that the disclosed embodiments may also be used in other applications where it is required to properly support a watercraft hull, such as with a watercraft trailer, a watercraft storage device, or other types of watercraft lifts, such as a floating watercraft lift. Accordingly, the invention is not limited except as by the appended claims.

What is claimed is:

1. A bunk beam and bunk cushion assembly for supporting a watercraft having a hull, comprising:

a bunk beam having a plurality of first locking elements disposed on an attachment surface, the bunk beam having sufficient stiffness to support a portion of the weight of the watercraft transmitted through the bunk beam without permanent deformation but being yieldable to at least partially conform to the shape of the watercraft hull under the portion of the weight of the watercraft supported thereby; and a bunk cushion supported by the bunk beam, the bunk cushion having a watercraft support surface engageable with the watercraft hull and a plurality of second locking elements disposed on a lower surface of the cushion, the plurality of second locking elements being configured to lockably engage the first locking elements to maintain the bunk cushion in position on and attached to the bunk beam such that during use the bunk cushion engages the watercraft hull and supports the portion of the weight of the watercraft supported by the bunk beam.

2. The assembly according to claim 1 wherein the plurality of first locking elements comprise a plurality of recesses, and the plurality of second locking elements comprise a corresponding plurality of members configured to extend outwardly from the bunk cushion and into the recesses to hold the bunk cushion in position on and attached to the bunk beam.

3. The assembly according to claim 1 wherein the bunk beam attachment surface includes a cushion support surface portion configured to support the cushion lower surface and the plurality of first locking elements include a longitudinally extending central recess in the bunk beam projecting away from the cushion support surface, the recess having a neck portion toward the cushion support surface and an anchor portion positioned away from the cushion support surface, the recess anchor portion having a width greater than the recess neck portion, and wherein the second plurality of locking elements include a longitudinally extending central locking member projecting away from the cushion lower surface and into the recess, the central locking member having a neck portion toward the cushion lower surface and a lock portion positioned away from the cushion lower surface, the cushion neck portion having a width sized to fit within the recess neck portion and the cushion lock portion having a width sized to lockably fit within the recess anchor portion, the cushion lock portion width being greater than the recess neck portion but having sufficient compressibility to be insertable through the recess neck portion upon construction of the assembly and resiliency to then attain the width size to lockably fit within the recess anchor portion.

4. The assembly according to claim 3 wherein the plurality of first locking elements further include a pair of oppositely projecting flange portions, and the plurality of second locking elements further include a pair of oppositely projecting side extensions, each extending around and grasping a correspondingly positioned one of the pair of flange portions.

5. The assembly according to claim 1 wherein the bunk beam attachment surface includes a cushion support surface portion configured to support the cushion lower surface and the plurality of first locking elements include a longitudinally extending recess in the bunk beam projecting away from the cushion support surface, the recess having a neck portion toward the cushion support surface and an anchor portion positioned away from the cushion support surface, the recess anchor portion having a width greater than the recess neck portion, and wherein the second plurality of locking elements include a longitudinally extending locking member projecting away from the cushion lower surface and into the recess, the locking member having a neck portion toward the cushion lower surface and a lock portion positioned away from the cushion lower surface, the cushion neck portion having a width sized to fit within the recess neck portion and the cushion lock portion having a width sized to lockably fit within the recess anchor portion, the cushion lock portion width being greater than the recess neck portion width.

6. The assembly according to claim 1 for attachment to a pair of support booms, wherein the bunk beam attachment surface includes a cushion support surface portion configured to support the cushion lower surface and the bunk beam further comprises first and second support webs rigidly attached to the attachment surface, the first and second support webs projecting away from the attachment surface on a side thereof away from the cushion support surface and being configure to attach to the support booms.

7. The assembly according to claim 6 wherein the first and second webs have toward each end portion of the bunk beam a transverse bore sized to receive a pin for pivotal connection of the bunk beam to a correspondingly positioned one of the pair of support booms, the first and second webs having a lower wall portion and an upper wall portion positioned between the lower wall portion and the cushion support surface portion, the lower wall portion having a wall thickness greater than the wall thickness of the upper wall portion in at least the area around the transverse bores to provide within the transverse bores a bearing surface for engagement with the pin when extending therethrough.

8. The assembly according to claim 7 wherein the thickness of the lower wall portion around the bores is at least 1.8 times the thickness of the upper wall portion.

9. The assembly according to claim 6 wherein the first web has a height shorter that the second web to hold the cushion support surface at an angle to the horizon when the first and second support webs are attached to the support booms.

10. The assembly according to claim 1 wherein the bunk cushion further comprises a convex upper surface opposite the cushion lower surface.

11. The assembly according to claim 1 wherein the bunk cushion has an unloaded height above the cushion support surface portion at least 0.1875 times the width of the bunk cushion.

12. The assembly according to claim 11 wherein the bunk cushion has a stiffness such that under loading by the watercraft the loaded height above the cushion support surface portion will be at least 0.5 times the unloaded height.

13. The assembly according to claim 1 wherein the bunk cushion is comprised of an elastomeric material.

14. The assembly according to claim 13 wherein the bunk cushion has at least one interior void and a pair of adjacent interior resilient walls.

15. The assembly according to claim 1 wherein the bunk beam comprises a stiff material having sufficient rigidity to support the watercraft and sufficient flexibility to at least partially conform to the shape of the watercraft.

16. The assembly according to claim 15 wherein the bunk beam material is aluminum.

17. The assembly according to claim 15 wherein the bunk beam is an extruded member.

18. The assembly according to claim 1 wherein the first locking elements include a centrally disposed recess, and opposing first and second side recesses, and the second locking elements are a central locking member projecting into the recess and opposing first and second side members projecting into the first and second side recesses, respectively.

19. A bunk beam and bunk cushion assembly for supporting a watercraft having a hull, comprising:

an elongated bunk beam having an elongated cushion support surface portion and a longitudinally extending recess projecting away from the cushion support surface, the recess having a neck portion toward the cushion support surface and an anchor portion positioned away from the cushion support surface, the recess anchor portion having a width greater than the recess neck portion; and an elongated bunk cushion having a lower surface in supporting engagement with the cushion support surface portion of the bunk beam and an upper watercraft support surface engageable with the watercraft hull, the bunk cushion having a longitudinally extending locking rib projecting away from the cushion lower surface and into the recess, the locking rib having a neck portion toward the cushion lower surface and a lock portion positioned away from the cushion lower surface, the cushion neck portion having a width sized to fit within the recess neck portion and the cushion lock portion having a width sized to lockably fit within the recess anchor portion, the cushion lock portion width being greater than the recess neck portion, the cushion neck portion having a thickness sufficient to provide shear strength to maintain the bunk cushion in position on the cushion support surface portion of the bunk beam against side loading forces exerted by the watercraft during use and the cushion lock portion having a thickness sufficient to not pull through the recess neck portion to maintain the bunk cushion in position on the cushion support surface portion of the bunk beam against lifting forces exerted by the watercraft during use, whereby the cushion locking rib maintains the bunk cushion in stationary position on and attached to the bunk beam during usage.

20. The assembly according to claim 19 wherein the cushion lock portion has sufficient compressibility to be insertable downward through the recess neck portion upon construction of the assembly.

21. The assembly according to claim 19 wherein the bunk beam has sufficient stiffness to support a portion of the weight of the watercraft transmitted through the bunk beam without permanent deformation but is yieldable to at least partially conform to the shape of the watercraft hull under the portion of the weight of the watercraft supported thereby.

22. The assembly according to claim 19 wherein the cushion support surface portion of the bunk beam is oriented at a predetermined fixed angle to the horizon so as to be facing toward the hull of the watercraft when in use to support the watercraft.

23. The assembly according to claim 22 wherein the bunk cushion further comprises a convex upper surface opposite the cushion lower surface and facing toward the hull of the watercraft when in use to support the watercraft.

24. The assembly according to claim 23 for attachment to first and second booms rotatable in a substantially vertical plane, wherein the bunk beam includes at least one attachment member configured to be pivotally attached to the first and second booms to move the bunk beam and bunk cushion as a unit in the substantially vertical plane with the first and second booms, with the bunk beam and bunk cushion comprising a non-movable assembly when in an elevated position supporting the hull of the watercraft.

25. The assembly according to claim 19 wherein the bunk beam further includes a pair of oppositely projecting flange portions, with the recess positioned therebetween, and the bunk cushion further includes a pair of oppositely projecting side extensions, each extending around and grasping a correspondingly positioned one of the pair of flange portions.

26. The assembly according to claim 19 wherein the bunk beam further includes opposing first and second side recesses, and the bunk cushion further includes opposing first and second side members projecting into the first and second side recesses, respectively, to hold assist the cushion locking rib maintain the bunk cushion in position on and attached to the bunk beam during usage.

27. The assembly according to claim 19 for attachment to first and second rotatable booms, wherein the bunk beam further includes first and second elongated support sidewalls having an upper edge portion supportingly attached to the cushion support surface portion, the first and second support sidewalls projecting downward from the cushion support surface portion and configured to be attached to the first and second booms.

28. The assembly according to claim 27 wherein the first and second support sidewalls each have first and second end portions, the first and second support sidewalls having a first transverse bore in the first end portion thereof sized to receive a first pin for pivotal connection to the first boom, and the first and second support sidewalls having a second transverse bore in the second end portion thereof sized to receive a second pin for pivotal connection to the second boom, the first and second support sidewalls each having an upper wall portion attached to the cushion support surface portion and a lower wall portion extending downward from the upper wall portion, the lower wall portion having a wall thickness greater than the wall thickness of the upper wall portion in at least the area around the first and second transverse bores to provide within the first and second transverse bores first and second bearing surfaces for engagement with the first and second pins, respectively, when extending therethrough.

29. The assembly according to claim 27 for use with a support structure including the first and second booms, wherein the bunk beam has first and second end portions, each configured to attach to a correspondingly positioned one of the first and second booms, without the support structure supporting the bunk beam at locations between the first and second end portions.

30. The assembly according to claim 27 wherein the thickness of the lower wall portion around the first and second bores is at least 1.8 times the thickness of the upper wall portion.

31. The assembly according to claim 27 wherein the first support sidewall is positionable toward the watercraft and has a height shorter that the second support sidewall to hold the cushion support surface portion at a predetermined angle to the horizon when the first and second support sidewalls attached to the support booms.

32. The assembly according to claim 19 wherein the bunk cushion further comprises a convex upper surface opposite the cushion lower surface.

33. The assembly according to claim 19 wherein the bunk cushion has an unloaded height above the cushion support surface portion at least 0.1875 times the width of the bunk cushion.

34. The assembly according to claim 33 wherein the bunk cushion has a stiffness such that under loading by the watercraft the loaded height above the cushion support surface portion will be at least 0.5 times the unloaded height.

35. The assembly according to claim 19 wherein the bunk cushion is comprised of an elastomeric material.

36. The assembly according to claim 35 wherein the bunk cushion has at least first, second and third adjacent interior void and a first interior resilient wall between the first and second interior voids and a second interior resilient wall between the second and third interior voids.

37. The assembly according to claim 19 wherein the bunk beam comprises a stiff material having sufficient rigidity to support the watercraft and sufficient flexibility to at least partially conform to the shape of the watercraft.

38. The assembly according to claim 37 wherein the bunk beam material is an extruded aluminum member.

39. A bunk beam and bunk cushion assembly for supporting a watercraft having a hull, comprising:

an elongated bunk beam having an elongated cushion support surface portion and a longitudinally extending slot; and an elongated bunk cushion having a lower surface in supporting engagement with the cushion support surface portion of the bunk beam and an upper watercraft support surface engageable with the watercraft hull, the bunk cushion having a longitudinally extending locking rib projecting away from the cushion lower surface and into the slot, the cushion locking rib having a thickness sufficient to provide shear strength to maintain the bunk cushion in position on the cushion support surface portion of the bunk beam against side loading forces exerted by the watercraft during use.

40. The assembly according to claim 39 wherein the bunk beam has sufficient stiffness to support a portion of the weight of the watercraft transmitted through the bunk beam without permanent deformation but is yieldable to at least partially conform to the shape of the watercraft hull under the portion of the weight of the watercraft supported thereby.

41. The assembly according to claim 39 wherein the cushion support surface portion of the bunk beam is oriented at a predetermined fixed angle to the horizon so as to be facing toward the hull of the watercraft when in use to support the watercraft.

42. The assembly according to claim 41 wherein the bunk cushion further comprises a convex upper surface opposite the cushion lower surface and facing toward the hull of the watercraft when in use to support the watercraft.

43. The assembly according to claim 42 for attachment to first and second booms rotatable in a substantially vertical plane, wherein the bunk beam includes at least one attachment member configured to be pivotally attached to the first and second booms to move the bunk beam and bunk cushion as a unit in the substantially vertical plane with the first and second booms, with the bunk beam and bunk cushion comprising a non-movable assembly when in an elevated position supporting the hull of the watercraft.

44. A bunk beam and bunk cushion assembly for supporting a watercraft having a hull, comprising:

an elongated bunk beam having an elongated cushion support surface portion oriented at a predetermined fixed angle to the horizon so as to be facing toward the hull of the watercraft when in use to support the watercraft; and an elongated bunk cushion having a lower surface portion in supporting engagement with the cushion support surface portion of the bunk beam and an upper watercraft support surface portion engageable with the watercraft hull, the cushion upper surface portion being convex in shape and projecting away from the cushion lower surface portion, the cushion support surface portion of the bunk beam holding the cushion upper surface portion facing toward the hull of the watercraft for engagement therewith when in use to support the watercraft, the bunk cushion and the bunk beam being attached together in stationary relation for movement as a unit, the bunk cushion having a longitudinally extending locking rib projecting away from the cushion lower surface portion and into a longitudinally extending recess of the bunk beam, the locking rib being lockably retained in the bunk beam recess, whereby the cushion locking rib maintains the bunk cushion in stationary position on and attached to the bunk beam during usage.

45. The assembly according to claim 44 for attachment to first and second booms rotatable in a substantially vertical plane, wherein the bunk beam includes at least one attachment member configured to be pivotally attached to the first and second booms to move the bunk beam and the bunk cushion as a unit in the substantially vertical plane with the first and second booms, with the bunk beam and bunk cushion comprising a non-movable assembly when in an elevated position supporting the hull of the watercraft.

46. A bunk beam and bunk cushion assembly for supporting a watercraft having a hull, comprising:

an elongated bunk beam having an elongated cushion support surface portion oriented at a predetermined fixed angle to the horizon so as to be facing toward the hull of the watercraft when in use to support the watercraft, the bunk beam further including a longitudinally extending recess projecting away from the cushion support surface, the recess having a neck portion toward the cushion support surface and an anchor portion positioned away from the cushion support surface, the recess anchor portion having a width greater than the recess neck portion; and an elongated bunk cushion having a lower surface in supporting engagement with the cushion support surface portion of the bunk beam and an upper watercraft support surface engageable with the watercraft hull, the cushion upper surface being convex in shape and projecting away from the cushion lower surface, the cushion support surface portion of the bunk beam holding the cushion upper surface facing toward the hull of the watercraft for engagement therewith when in use to support the watercraft, the bunk cushion having a longitudinally extending locking member projecting away from the cushion lower surface and into the recess to hold the bunk cushion and the bunk beam together in stationary relation for movement as a unit, the locking member having a neck portion toward the cushion lower surface and a lock portion positioned away from the cushion lower surface, the cushion neck portion having a width sized to fit within the recess neck portion and the cushion lock portion having a width sized to lockably fit within the recess anchor portion, the cushion lock portion width being greater than the recess neck portion, the cushion neck portion having a thickness sufficient to provide shear strength to maintain the bunk cushion in position on the cushion support surface portion of the bunk beam against side loading forces exerted by the watercraft during use and the cushion lock portion having a thickness sufficient to not pull through the recess neck portion to maintain the bunk cushion in position on the cushion support surface portion of the bunk beam against lifting forces exerted by the watercraft during use, whereby the cushion locking member maintains the bunk cushion in stationary position on and attached to the bunk beam during usage.

47. The assembly according to claim 46 wherein the bunk beam has sufficient stiffness to support a portion of the weight of the watercraft transmitted through the bunk beam without permanent deformation but is yieldable to at least partially conform to the shape of the watercraft hull under the portion of the weight of the watercraft supported thereby.

48. A watercraft lift for supporting a watercraft having a hull, comprising:

a support platform positionable in a first position to support the watercraft above a body of water, and positionable in a second position to position the watercraft in the body of water, the support platform including a first and second bunk beam and bunk cushion assemblies in spaced a part substantially parallel arrangement, the first and second bunk beam and bunk cushion assemblies each including an elongated bunk beam having an elongated cushion support surface portion and an elongated bunk cushion having a lower surface in supporting engagement with the cushion support surface portion of the bunk beam, the bunk beam further having a longitudinally extending recess projecting away from the cushion support surface, the recess having a neck portion toward the cushion support surface and an anchor portion positioned away from the cushion support surface, the recess anchor portion having a width greater than the recess neck portion, and the bunk cushion further having an upper watercraft support surface engageable with the watercraft hull, the bunk cushion having a longitudinally extending locking rib projecting away from the cushion lower surface and into the recess, the locking rib having a neck portion toward the cushion lower surface and a lock portion positioned away from the cushion lower surface, the cushion neck portion having a width sized to fit within the recess neck portion and the cushion lock portion having a width sized to lockably fit within the recess anchor portion, the cushion lock portion width being greater than the recess neck portion, the cushion neck portion having a thickness sufficient to provide shear strength to maintain the bunk cushion in position on the cushion support surface portion of the bunk beam against side loading forces exerted by the watercraft during use and the cushion lock portion having a thickness sufficient to not pull through the recess neck portion to maintain the bunk cushion in position on the cushion support surface portion of the bunk beam against lifting forces exerted by the watercraft during use, whereby the cushion locking rib maintains the bunk cushion in stationary position on and attached to the bunk beam during usage, and the bunk beam and bunk cushion form a non-movable assembly when in the first position supporting the hull of the watercraft above the body of water.

49. The lift according to claim 48 wherein the cushion lock portion has sufficient compressibility to be insertable downward through the recess neck portion upon construction of the assembly.

50. The lift according to claim 48 further including first and second left side rotatable booms and first and second right side rotatable booms, the bunk beam of the first bunk beam and bunk cushion assembly having first and second elongated support sidewalls having an upper edge portion supportingly attached to the cushion support surface portion of the first bunk beam and bunk cushion assembly and the bunk beam of the second bunk beam and bunk cushion assembly having first and second elongated support sidewalls having an upper edge portion supportingly attached to the cushion support surface portion of the second bunk beam and bunk cushion assembly, each of the first and second support sidewalls projecting downward from the cushion support surface portion and configured to be attached to the corresponding side first and second booms.

51. The lift according to claim 50 wherein the first and second support sidewalls of the bunk beams of the first and second bunk beam and bunk cushion assemblies each have first and second end portions, the first and second support sidewalls having a first transverse bore in the first end portion thereof sized to receive a first pin for pivotal connection to the corresponding side first boom, and the first and second support sidewalls having a second transverse bore in the second end portion thereof sized to receive a second pin for pivotal connection to the corresponding side second boom, the first and second support sidewalls each having an upper wall portion attached to the cushion support surface portion and a lower wall portion extending downward from the upper wall portion, the lower wall portion having a wall thickness greater than the wall thickness of the upper wall portion in at least the area around the first and second transverse bores to provide within the first and second transverse bores first and second bearing surfaces for engagement with the first and second pins, respectively, when extending therethrough.

52. The assembly according to claim 48 wherein the bunk beams of the first and second bunk beam and bunk cushion assemblies each has sufficient stiffness to support a portion of the weight of the watercraft transmitted through the bunk beam without permanent deformation but is yieldable to at least partially conform to the shape of the watercraft hull under the portion of the weight of the watercraft supported thereby.

53. The assembly according to claim 48 wherein the bunk beams of the first and second bunk beam and bunk cushion assemblies each has a pair of oppositely projecting flange portions, with the recess positioned therebetween, and the bunk cushions of the first and second bunk beam and bunk cushion assemblies each has a pair of oppositely projecting side extensions, each extending around and grasping a correspondingly positioned one of the pair of flange portions.

54. The assembly according to claim 48 wherein the bunk beams of the first and second bunk beam and bunk cushion assemblies each has opposing first and second side recesses, and the bunk cushions of the first and second bunk beam and bunk cushion assemblies each has opposing first and second side members projecting into the first and second side recesses, respectively, to hold assist the cushion locking rib maintain the bunk cushion in position on and attached to the bunk beam during usage.

* * * * *